US008439771B1

(12) United States Patent
Fleming

(10) Patent No.: US 8,439,771 B1
(45) Date of Patent: May 14, 2013

(54) GOLF TRAINING TEE

(76) Inventor: Larry Fleming, Sand Springs, OK (US)

( * ) Notice: Subject to any disclaimer, the term of this patent is extended or adjusted under 35 U.S.C. 154(b) by 0 days.

(21) Appl. No.: 13/420,326

(22) Filed: Mar. 14, 2012

Related U.S. Application Data

(60) Provisional application No. 61/465,248, filed on Mar. 15, 2011.

(51) Int. Cl.
*A63B 57/00* (2006.01)
*A63B 69/36* (2006.01)

(52) U.S. Cl.
USPC ..... 473/397; 473/257

(58) Field of Classification Search ..... 473/257, 473/387–403, 575, 576
See application file for complete search history.

(56) References Cited

U.S. PATENT DOCUMENTS

| | | | | |
|---|---|---|---|---|
| 1,623,119 | A | 4/1927 | Kearney | |
| 1,807,377 | A | 5/1931 | Brokaw | |
| 2,712,939 | A | 7/1955 | Harp | |
| 2,839,304 | A * | 6/1958 | Lerick | 473/397 |
| 3,018,109 | A | 1/1962 | Starck | |
| 3,414,268 | A | 12/1968 | Chase | |
| 3,966,214 | A | 6/1976 | Collins | |
| 4,418,916 | A | 12/1983 | Matsuura | |
| 4,645,208 | A * | 2/1987 | Morabeto | 473/397 |
| D301,046 | S | 5/1989 | Morabeto | |
| 5,375,838 | A | 12/1994 | Labriola et al. | |
| D360,006 | S | 7/1995 | Samples | |
| 5,755,629 | A | 5/1998 | Blomgren | |
| 6,899,644 | B1 * | 5/2005 | Song et al. | 473/397 |
| 7,374,501 | B2 | 5/2008 | Lu | |
| 2006/0058120 | A1 * | 3/2006 | Anton | 473/386 |
| 2006/0229144 | A1 | 10/2006 | Lee | |

FOREIGN PATENT DOCUMENTS

| | | |
|---|---|---|
| WO | 2007136623 | 11/2007 |

* cited by examiner

*Primary Examiner* — Nini Legesse
(74) *Attorney, Agent, or Firm* — QuickPatents; Kevin Prince

(57) ABSTRACT

A golf training tee includes a tee riser that has at a top end a cup adapted for receiving a golf ball thereon. A bottom end of the tee riser includes a substantially spherical ball member. A base has a socket at a top end thereof that is adapted for pivotally receiving the ball member. The socket has an open portion that includes a substantially flat stop surface. The base includes at a lower end thereof a ground attachment member, such as a spike adapted for insertion into a ground surface, or a flat disk adapted for resting on the ground surface. In use, when the golf ball is struck with the golf club, the tee riser pivots downwardly in a direction of the golf club at impact therewith. The tee riser stops its downward pivot at the stop surface of the socket, remaining pointed in the direction.

18 Claims, 3 Drawing Sheets

GOLF TRAINING TEE

CROSS-REFERENCE TO RELATED APPLICATIONS

This application claims the benefit of U.S. Provisional Patent Application 61/465,248, filed on Mar. 15, 2011, and incorporated herein by reference.

STATEMENT REGARDING FEDERALLY SPONSORED RESEARCH AND DEVELOPMENT

Not Applicable.

FIELD OF THE INVENTION

This invention relates to the sport of golf, and more particularly to a practice golf tee.

DISCUSSION OF RELATED ART

The standard golf tee, which consists of a wooden spike having a cupped upper end into which a golf ball rests, has been improved on in various ways in the prior art. One such improvement has been to device a golf tee that does not break when struck by a golf club, which is typical of the wooden golf tee. Various types of plastic tees having a rotatable or break-away cup have been devices, for example. Such prior art golf tees may be found in the following patents:

| Pub. No. | Inventor | Pub. Date |
|---|---|---|
| 1,623,119 | Kearney | Apr. 5, 1927 |
| 1,807,377 | Brokaw | May 26, 1931 |
| 2,712,939 | Harp | Jul. 12, 1955 |
| 2,839,304 | Lerick | Jun. 17, 1958 |
| 3,414,268 | Chase | Dec. 3, 1968 |
| 3,966,214 | Collins | Jun. 29, 1976 |
| 4,418,916 | Matsuura | Dec. 6, 1983 |
| 4,645,208 | Morabeto | Feb. 24, 1987 |
| 5,375,838 | Labriola et al. | Dec. 27, 1994 |
| 5,755,629 | Blomgren | May 26, 1998 |
| 7,374,501 | Lu | May 20, 2008 |
| 2006/0229144 | Lee | Oct. 12, 2006 |
| WO 2007/136623 | Salmon | Nov. 29, 2007 |
| D301,046 | Morabeto | May 9, 1989 |
| D360,006 | Samples | Jul. 4, 1995 |

In these prior art patents, several designs for a golf tee that rotates down when struck by a golf club are evident. However, all of the prior art devices depict a tee that rotates down in only one rotational direction, providing zero feedback to the golfer as to the direction of his golf club or the angle of the face of the golf club at impact.

Several swing direction indicators exist in the prior art that incorporate a golf tee. For example, U.S. Pat. No. 2,712,939 to Harp on Jul. 12, 1955 teaches such a device, in which a golf tee is positioned centrally on a flat plate and a plurality of upright pegs are positioned around the golf tee. If the pegs are knocked down after a golf swing, the knocked-down pegs indicate that the golf club contacted the pegs in error and thus feedback is provided to the golfer. However, no feedback is provided in such a device to indicate the angle of the face of the golf club head at impact with the ball, even if the golf club was traveling properly straight. Moreover, the precise direction of the golf club at impact is not clearly indicated by such a device, the pegs only being able to provide feedback that the club was traveling from left-to-right or from right-to-left, in a somewhat digital indication. The embodiment of FIG. 8 may at first appear to be capable of indicating a direction of the golf club or an indication of the angle of the golf club head at impact with the ball. However, the curved socket in such an embodiment serves to deflect the downward-traveling tee riser and, as a result, information about the initial trajectory of the golf club or the angle of the golf club is lost once the tee riser contacts the curved socket and is deflected.

Another example of such a direction-indicating device is taught in U.S. Pat. No. 3,018,109 to Starck on Jan. 23, 1962. In this device, a golf tee is positioned between several pegs that are positioned upright, and which terminate at a lower end in a ball and socket swivel. Such a device, as with the Harp device, does not indicate the club head angle at the point of impact with the ball. Further, this type of device does not indicate the direction of the club if it varies widely from the aligned pegs. Moreover, this type of product cannot be used on a golf course or with existing practice mats, since it is too large. Moreover, if the golf ball strikes one of the pegs itself, not only can the trajectory of the golf ball be affected, but an incorrect reading of the peg may result.

Therefore, there is a need for a device that will indicate the club head angle and direction of club head travel upon impact with a golf ball. Such a needed device would take the place of a conventional golf tee, and would not require special practice mats or the like. Such a device could also be used during a regular game of golf, perhaps not within the rules of professional golf but certainly from a practical standpoint and during practice games. Such a needed invention would not interfere with the travel of the golf ball itself or provide inaccurate indication of club direction or club angle from impact with the golf ball itself after impact. Further, such a needed device would be inexpensive to manufacture and easy to use, and would provide for a variety of golf ball tee heights. The present invention accomplishes these objectives.

SUMMARY OF THE INVENTION

The present device is a golf training tee for a golfer to use with a golf ball and a golf club. The tee includes a tee riser that has at a top end a cup adapted for receiving the golf ball thereon. A bottom end of the tee riser includes a substantially spherical ball member.

A base has a socket at a top end thereof that is adapted for pivotally receiving the ball member of the tee riser therein. The socket has an open portion on a front side thereof, the open portion including a substantially flat stop surface. The socket may impart a frictional force on the ball member sufficient to stop the ball member from moving within the socket when less than one ounce of force is applied tangentially to the top end of the tee riser, for example. As such, the ball member is not free to move around within the socket by gravity or other casual, minor forces.

In one embodiment, the socket may include a plurality of resilient socket walls mutually unattached at sides thereof, such that the socket walls may flex momentarily outward to allow insertion, removal, and movement of the ball member of the tee riser therein or therefrom. As such, the golf training tee of the present invention may include one or more tee risers, each having a mutually unique height.

The base includes at a lower end thereof a ground attachment member, such as a spike adapted for insertion into a ground surface, or a flat disk adapted for resting on the ground surface.

In use, when the golf ball is struck with the golf club, the tee riser pivots downwardly in a direction of the golf club at impact therewith. The tee riser stops its downward pivot at the stop surface of the socket, remaining pointed in the direction. As such, the golfer has an indication of the direction of the golf club at impact, providing educational feedback to the golfer. The golfer has additional motivation to look at the tee after impact, helping to keep his head down during his swing of the golf club, which promotes a better form and swing.

The present invention indicates the club head angle and direction of club head travel upon impact with a golf ball. The present device takes the place of a conventional golf tee, and does not require special practice mats or the like, although the present invention may be used with conventional practice mats. Further, the present invention may be used during a regular practice round of golf, as it does not interfere with the travel of the golf ball itself or provide inaccurate indication of club direction or club angle from impact with the golf ball itself after impact. Further, the present device is inexpensive to manufacture and easy to use, and provides for a variety of golf ball tee heights. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
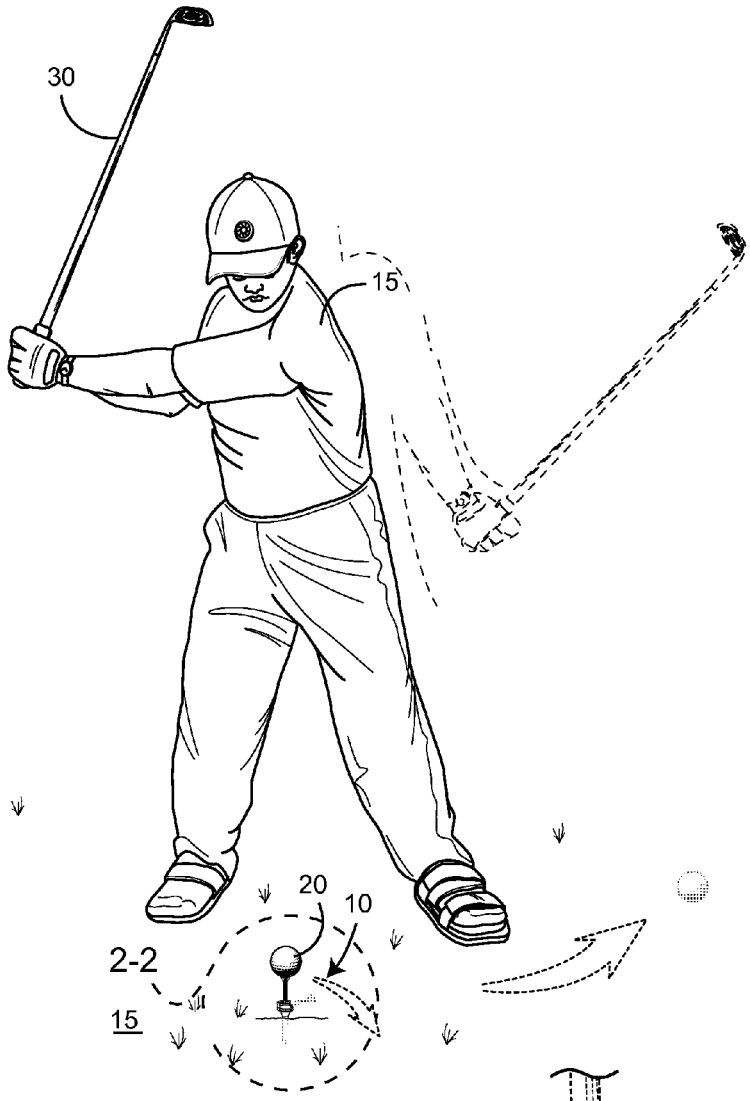
FIG. 1 is a perspective view of the invention, illustrating a golfer striking a golf ball on the golf training tee of the present invention.
Figure 2:
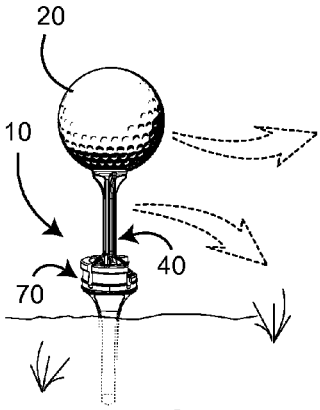
FIG. 2 is a perspective view of the invention, illustrated holding a golf ball before impact with a golf club.
Figure 3:
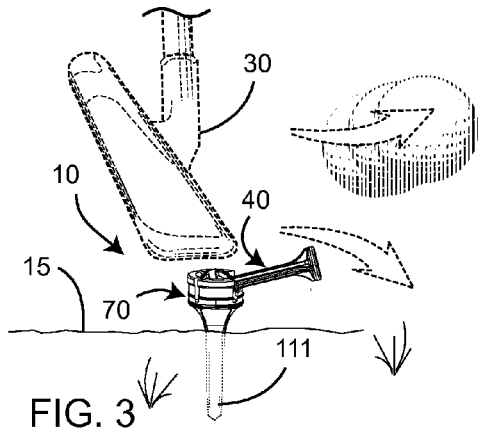
FIG. 3 is a perspective view of the invention illustrated just after impact with the golf club.

FIGS. 1-3 illustrate a golf training tee 10 for a golfer 15 to use with a golf ball 20 and a golf club 30. The tee 10 includes a tee riser 40 that has at a top end 48 a cup 50 adapted for receiving the golf ball 20 thereon. The cup 50 is concave so as to capture the golf ball 20. A bottom end 42 of the tee riser 40 includes a substantially spherical ball member 60. The tee riser 40 may be made from an injection molded plastic material, wood, rubber, or other suitable and durable material.

Figures 4, 5:
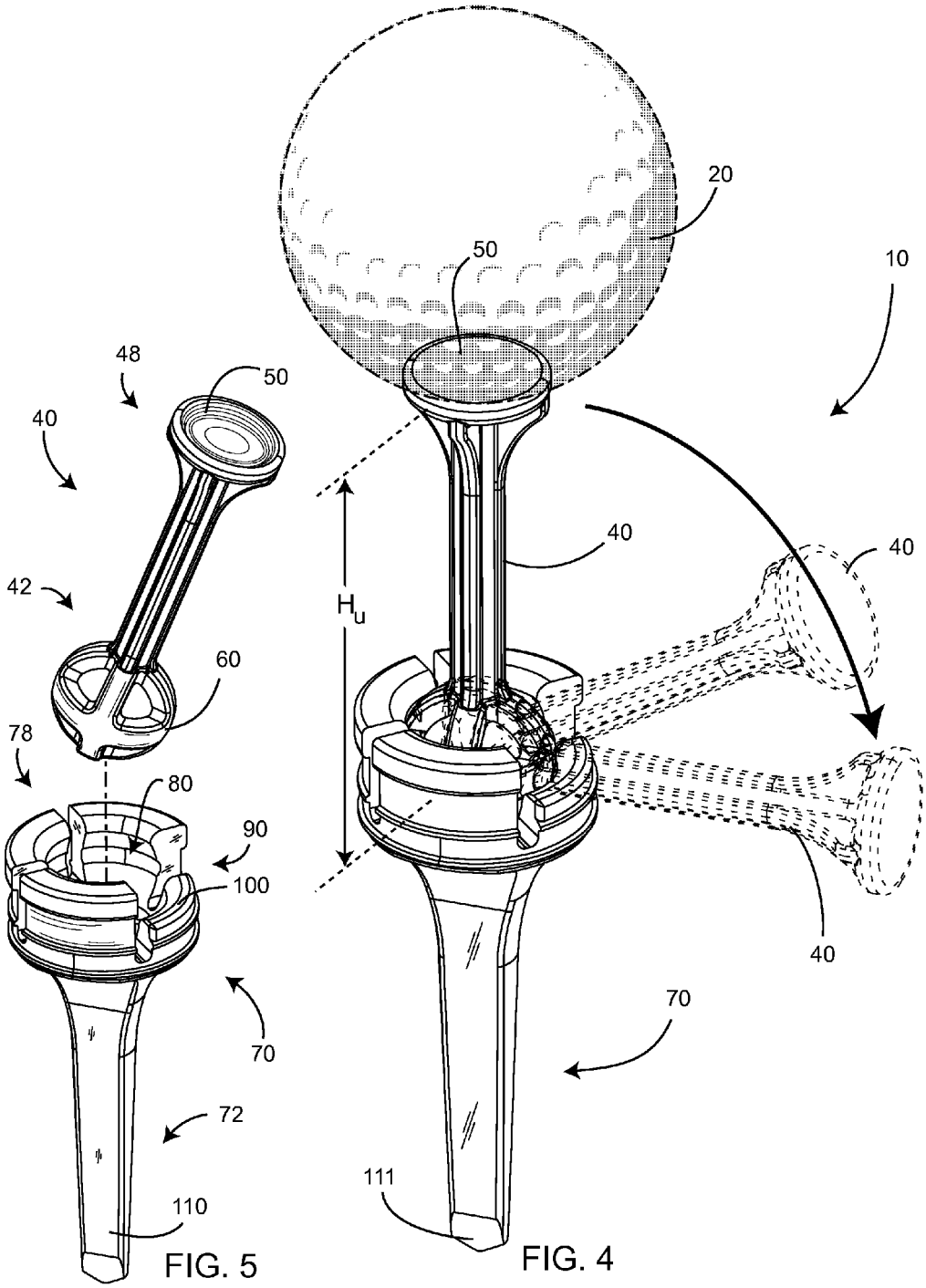
FIG. 4 is an enlarged perspective view of the invention.
FIG. 5 is an exploded perspective view of the invention, illustrating a base and a tee riser of the invention.

A base 70 has a socket 80 at a top end 78 thereof that is adapted for pivotally receiving the ball member 60 of the tee riser 40 therein. The socket 80 has an open portion 90 on a front side thereof, the open portion 90 including a substantially flat stop surface 100 (FIGS. 4 and 5). The socket 80 may impart a frictional force on the ball member 60 sufficient to stop the ball member 60 from moving within the socket 80 when less than one ounce of force is applied tangentially to the top end 78 of the tee riser 40, for example. As such, the ball member 60 is not free to move around within the socket 80 by gravity or other casual, minor forces. The base 70 may be made from an injection molded plastic material, wood, rubber, or other suitable and durable material.

In one embodiment, the ball member 60 includes at least one protrusion 120 (FIG. 7) for increasing the friction imparted by the ball member 60 within the socket 80. In another embodiment, the ball member 60 has a slightly ovoid-shape (not shown), such that the socket 80 of the base 70 is forced to expand as the tee riser 40 drops from an upright position 130 (FIG. 6) to a knocked-down position 140.

Figure 6:
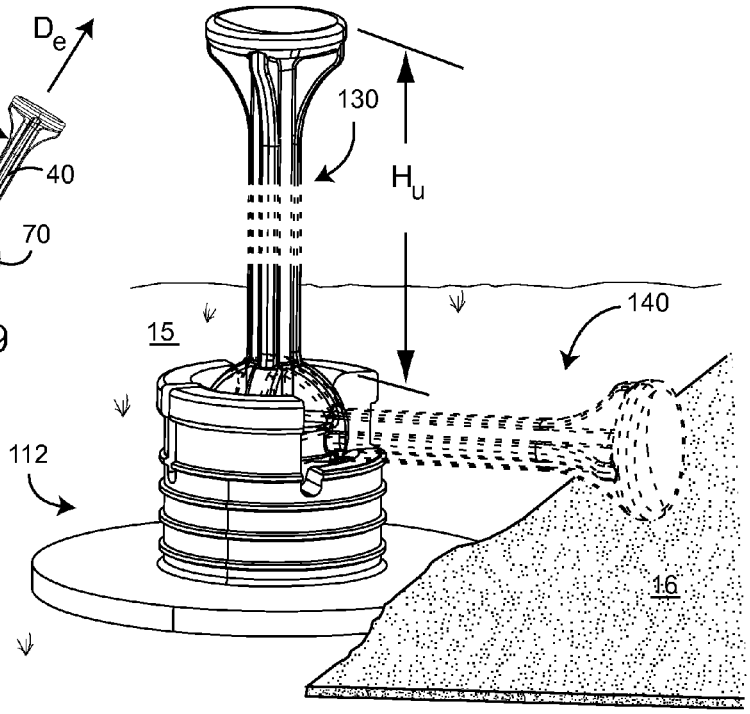
FIG. 6 is a perspective view of one embodiment of the base of the invention.
Figure 7:
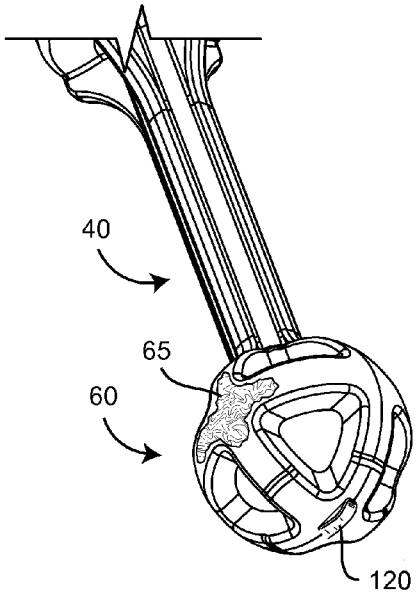
FIG. 7 is a partial perspective view of one embodiment of the tee riser of the invention.
Figure 8:
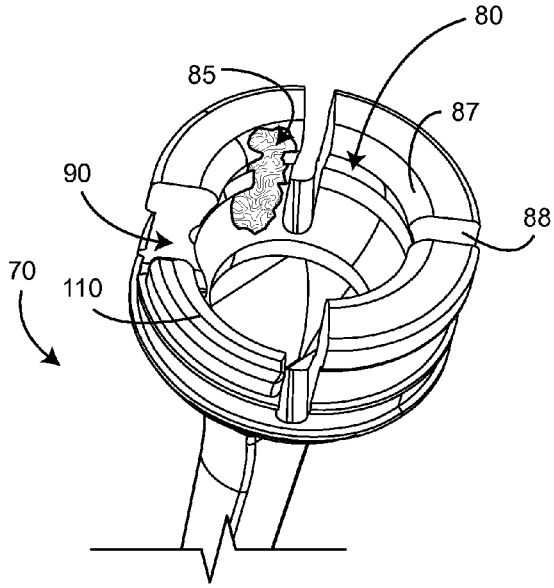
FIG. 8 is a partial perspective view of one embodiment of the base.

In one embodiment, the socket 80 may include a plurality of resilient socket walls 87 (FIG. 8) mutually unattached at sides 88 thereof, such that the socket walls 87 may flex momentarily outward to allow insertion, removal, and movement of the ball member 60 of the tee riser 40 therein or therefrom. As such, the golf training tee 10 of the present invention may include one or more tee risers 40, each having a mutually unique height $H_n$ (FIG. 6). For example, each base 70 may include three interchangeable tee risers 40, each of different heights.

In one embodiment, the ball member 60 includes an irregular outer surface 65 (FIG. 7) for increasing the friction imparted by the ball member 60 within the socket 80. Alternately, or additionally, the socket 80 may include an irregular inner surface 85 for increasing the friction imparted by the socket 80 on the ball member 60.

The base 70 includes at a lower end 72 thereof a ground attachment member 110. Such a ground attachment member 110 may include a spike 11 adapted for insertion into a ground surface 15 (FIG. 3). Alternately, the ground attachment member 110 is a flat disk 112 adapted for resting on the ground surface 15. Such a flat disk 112 may extend peripherally outwardly from the base 70, such that the disk 112 may be captured between a golf practice mat 16 and the ground surface 15, for example.

Figure 9:
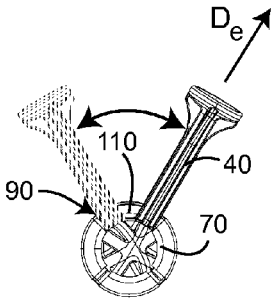
FIG. 9 is a top plan view of the invention, illustrating an impact direction of the golf club with the tee riser.

In use, when the golf ball 20 is struck with the golf club 30, the tee riser 40 pivots downwardly in a direction $D_e$ (FIG. 9) of the golf club 30 at impact therewith. The tee riser 40 stops its downward pivot at the stop surface 100 of the socket 80, remaining pointed in the direction $D_e$. As such, the golfer 15 has an indication of the direction of the golf club 30 at impact, providing educational feedback to the golfer 15. The golfer 15 has additional motivation to look at the tee 10 after impact, helping to keep his head down during his swing of the golf club 30, which promotes a better form and swing.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A golf training tee comprising:

a tee riser having at a top end a cup adapted for receiving a golf ball thereon, and at a bottom end thereof a substantially spherical ball member;

a base having a socket at a top end thereof, the socket adapted for pivotally receiving the ball member of the tee riser therein and having an open portion on a front side thereof, the open portion having a substantially flat stop surface, a lower end of the base having a ground attachment member;

wherein the ball member is slightly ovoid-shaped, such that the socket of the base is forced to expand as the tee riser drops from an upright position to a knocked-down position;

whereby when the golf ball is struck with a golf club, the tee riser pivots downwardly in a direction of the golf club at impact therewith, stopping its downward pivot at the stop surface of the socket.

2. The golf training tee of claim 1 wherein the socket of the base imparts a frictional force on the ball member sufficient to stop the ball member from moving within the socket when less than one ounce of force is applied tangentially to the top end of the tee riser.

3. The golf training tee of claim 1 wherein the ground attachment member is a spike adapted for insertion into a ground surface.

4. The golf training tee of claim 1 wherein the ground attachment member is a flat disk adapted for resting on a ground surface.

5. The golf training tee of claim 4 wherein the flat disk extends peripherally outwardly from the base, whereby the disk may be captured between a golf practice mat and the ground surface.

6. The golf training tee of claim 1 further including at least one additional tee riser, each tee riser having a mutually unique height, the socket adapted for pivotally receiving the ball member of one of the tee risers therein.

7. The golf training tee of claim 6 wherein the socket of the base imparts a frictional force on each ball member sufficient to stop the ball member from moving within the socket when less than one ounce of force is applied tangentially to the top end of the tee riser.

8. The golf training tee of claim 6 wherein the ball member of each tee riser includes at least one protrusion for increasing the friction imparted by the ball member within the socket.

9. The golf training tee of claim 6 wherein the ball member of each tee riser includes an irregular outer surface for increasing the friction imparted by the ball member within the socket.

10. The golf training tee of claim 6 wherein the socket includes an irregular inner surface for increasing the friction imparted by the socket on the ball member of each tee riser.

11. The golf training tee of claim 6 wherein the ground attachment member is a spike adapted for insertion into a ground surface.

12. The golf training tee of claim 6 wherein the ground attachment member is a flat disk adapted for resting on a ground surface.

13. The golf training tee of claim 12 wherein the flat disk extends peripherally outwardly from the base, whereby the disk may be captured between a golf practice mat and the ground surface.

14. The golf training tee of claim 6 wherein the socket includes a plurality of socket walls mutually unattached at sides thereof, such that the socket walls may flex momentarily outward to allow insertion and removal of the ball member of each tee riser therein.

15. The golf training tee of claim 1 wherein the socket includes a plurality of socket walls mutually unattached at sides thereof, such that the socket walls may flex momentarily outward to allow insertion and removal of the ball member of the tee riser therein.

16. A golf training tee comprising:

a tee riser having at a top end a cup adapted for receiving a golf ball thereon, and at a bottom end thereof a substantially spherical ball member;

a base having a socket at a top end thereof, the socket adapted for pivotally receiving the ball member of the tee riser therein and having an open portion on a front side thereof, the open portion having a substantially flat stop surface, a lower end of the base having a ground attachment member;

wherein the ball member includes at least one protrusion for increasing the friction imparted by the ball member within the socket;

whereby when the golf ball is struck with a golf club, the tee riser pivots downwardly in a direction of the golf club at impact therewith, stopping its downward pivot at the stop surface of the socket.

17. A golf training tee comprising:

a tee riser having at a top end a cup adapted for receiving a golf ball thereon, and at a bottom end thereof a substantially spherical ball member;

a base having a socket at a top end thereof, the socket adapted for pivotally receiving the ball member of the tee riser therein and having an open portion on a front side thereof, the open portion having a substantially flat stop surface, a lower end of the base having a ground attachment member;

wherein the ball member includes an irregular outer surface for increasing the friction imparted by the ball member within the socket;

whereby when the golf ball is struck with a golf club, the tee riser pivots downwardly in a direction of the golf club at impact therewith, stopping its downward pivot at the stop surface of the socket.

18. A golf training tee comprising:

a tee riser having at a top end a cup adapted for receiving a golf ball thereon, and at a bottom end thereof a substantially spherical ball member;

a base having a socket at a top end thereof, the socket adapted for pivotally receiving the ball member of the tee riser therein and having an open portion on a front side thereof, the open portion having a substantially flat stop surface, a lower end of the base having a ground attachment member;

wherein the socket includes an irregular inner surface for increasing the friction imparted by the socket on the ball member;

whereby when the golf ball is struck with a golf club, the tee riser pivots downwardly in a direction of the golf club at impact therewith, stopping its downward pivot at the stop surface of the socket.

* * * * *